US006526988B2

(12) United States Patent
Takehana

(10) Patent No.: US 6,526,988 B2
(45) Date of Patent: Mar. 4, 2003

(54) METHOD FOR TREATING HAIR SHAPE AND TREATING DEVICE THEREOF

(75) Inventor: Miki Takehana, Tokyo (JP)

(73) Assignee: Kikuboshi Corporation, Tokyo (JP)

( * ) Notice: Subject to any disclaimer, the term of this patent is extended or adjusted under 35 U.S.C. 154(b) by 0 days.

(21) Appl. No.: 09/811,784

(22) Filed: Mar. 20, 2001

(65) Prior Publication Data

US 2002/0026206 A1 Feb. 28, 2002

(51) Int. Cl.[7] ..... A45D 2/12
(52) U.S. Cl. ..... 132/207; 132/226
(58) Field of Search ..... 132/207, 210, 132/223, 224, 271, 226; 219/222

(56) References Cited

U.S. PATENT DOCUMENTS

| | | | | |
|---|---|---|---|---|
| 3,211,159 A | * | 10/1965 | Goble | 132/226 |
| 3,526,234 A | * | 9/1970 | Chrablow | 132/226 |
| 3,727,619 A | * | 4/1973 | Kuris | 132/271 |
| 4,023,579 A | * | 5/1977 | Suroff | 132/226 |
| 5,297,512 A | * | 3/1994 | Sharp | 132/271 |
| 5,875,789 A | * | 3/1999 | Shigihara | 132/210 |
| 6,196,236 B1 | * | 3/2001 | Imai et al. | 132/226 |

FOREIGN PATENT DOCUMENTS

| | | |
|---|---|---|
| JP | 8-299046 | 11/1996 |
| JP | 9-262119 | 10/1997 |
| JP | 9-262120 | 10/1997 |
| JP | 9-262121 | 10/1997 |
| JP | 9-262123 | 10/1997 |

* cited by examiner

*Primary Examiner*—Todd E. Manahan
(74) *Attorney, Agent, or Firm*—Armstrong, Westerman & Hattori, LLP

(57) ABSTRACT

A method for treating a hair shape comprising the steps of: subjecting hair to softening treatment by applying or spraying a softening agent or applying a hair-treating agent, and giving vibration of predetermined frequency of not exceeding 20 KHz being lower than a frequency of ultrasonic wave to hair to give a desired shape to hair. It is possible to cause cutting of cystine linkage, salt linkage, hydrogen linkage or the like in keratin of the hair, which was hard to be done in a conventional permanent treatment, to every portion of hairs by making an effect of the first liquid (softening agent) being sufficiently exhibited in permanent treatment.

12 Claims, 2 Drawing Sheets

METHOD FOR TREATING HAIR SHAPE AND TREATING DEVICE THEREOF

BACKGROUND OF THE INVENTION AND RELATED ART STATEMENT

The present invention relates to a method for treating a hair shape and an apparatus for treating it; said method being capable of treating hair for giving a shape thereto smoothly after softening treatment of hair with applying or spraying a softening agent, and its shape giving effect reaching to every portion thereof, thereby a given shape lasting for a long term, in comparison with a conventional method.

Human hair is generally composed of a protein called keratin similarly as skin and a nail. It is said that if keratin of hair is analyzed further in detail, an individual hair is composed of a medulla (a core/the marrow) composing the center of the hair; cortex a (cortex (portion in which spindle-shaped or cigar shaped cortex cells in which small keratin fibers are staffed up densely are vertically stuffed up densely)) composing circumference of the medulla; a matrix (gap-filling substance), which is superior in water absorptivity and moisture-holding ability, and which mutually bonds the cortex; and a cuticle composing circumference of a hair (a hair cuticle).

Therefore, essentially, it is preferable to keep it in mind to sufficiently supply high quality protein composing keratin in an everyday meal by taking, for example, meat and beans affluently to hold hair healthy forever. However, since hair is exposed outside, hair is easily damaged by being subjected to a sunbeam, adhesion of various kinds of materials floating in the atmosphere, and the like. Therefore, only the supply of previously described high quality protein is not sufficient for maintaining ideal health of hair, and it is the fact that a person does health care of a hair by giving oneself a shampoo, treatment or the like in order to remove the previously described damage from outside.

In addition, man is not satisfied with merely health care of a natural hair and satisfy his own sense of beauty by changing his hair-style variously, i.e., putting an artificial measure such as a permanent straight, a permanent wave or treatment on natural hair.

In conventional treatment (permanent treatment) technology to give a desired shape to hairs such as a permanent straight or a permanent wave, a softening treatment is conducted by applying or spraying a first liquid (a softening agent, a reducing agent, or cold liquid) to the whole hair which was washed cleanly, and then the whole hair is split into in a plural number, heat-treatment and combing are given on the split hair, or a cream-like material is applied, or the split hair is wrapped around hair rods in the event of a permanent wave, and then a hardening treatment is given by applying or spraying the second liquid (a hardening agent, an oxidizer or cold liquid), and in the case that hair rods are wrapped around with hair, they are detached after predetermined time, and finally a rinse treatment with warm water or the like is given.

In case of the conventional treatment technology of hair shape such as, for example, a permanent treatment, a treatment, or the like, there has been employed only so-called chemical treatment in which the hardness of hair is varied by sufficiently spraying cold liquid (a first liquid and a second liquid) on a matrix and a cuticle portion of hair, and in the treatment, heat-treatment and combing are given, or a cream-like material is applied to hair, or shape treatment of attaching and detaching hair rods to and from the split hair.

Because of this, a shape maintenance effect of a hair of a straight permanent, wave permanent or treatment is very short-lived.

It is thought that there is a cause in that a sufficient softening treatment and hardening treatment of hair cannot be conducted because it is necessary to apply or spray cold liquid in a constant short time because cold liquid gives remarkable damage to hair in a healthy state, and therefore it is impossible to make cold liquid fully spread out to a matrix and cuticle. In addition, it is generally believed to be one of the causes of the state that shape maintenance of hair is short-lived that a shape maintenance effect of hair after a permanent treatment is lost gradually because hair has a nature of returning in a natural state.

Thus, for example, a trial to variously adjust pH or the like of cold liquid depending on nature of hair of an individual person to be subjected to a permanent treatment is made in order to be able to hold a shape-maintenance effect of hair by the aforementioned cold liquid for a long time. However, it is the fact that a sufficient shape-maintenance effect cannot be obtained still now.

By the way, a number of polypeptide chains (the main chains) composing keratin, which is the chief ingredient of hair, are lined up in a vertical direction of a hair, and adjacent main chains make mesh structure by being connected with each other by means of side chains of cystine linkage, salt linkage, hydrogen linkage, and the like, and that by means of these linkages, hair is full of elasticity, and hair has a power of restitution to return in a former form immediately after a hand is released from the hair even if it is bent.

It is thought that to weaken power of restitution by cutting side chains of the cystine linkage, salt linkage, hydrogen linkage and the like, which give this power of restitution to hair is a function of the first permanent liquid, and to restitute linkage of a side chain at a new position where the hair is bent is a function of the second liquid, and a durable wave or the like is formed by means of this serial reaction. Of course, a principle of changing curly hair to extend twisted hair into straight and a principle of making a wave hair into straight hair are the same.

Previously described cystine linkage is also called S—S linkage, and it is thought that atoms of sulfur are mutually connected in form of —S—S—, and as a result hardness and elasticity similar to a nail are given to keratin, which is protein of hair. In a permanent treatment, it is the primarily important treatment to cut this cystine linkage, which is strong side chain linkage, and this cystine linkage is cut with the first liquid. And next, re-linkage of sulfur atoms by the second liquid is waited for, and a maintenance state of treated hair shape is prolonged.

By the way, thioglycolic acid, cysteine or acetylcysteine is usually used in the first liquid as a reducing agent. A point of sameness in component structure of these three kinds of reducing agents is to include a portion where a hydrogen atom links with a sulfur atom directly. A chemical reaction cutting of cystine linkage by the first liquid is shown in the following scheme.

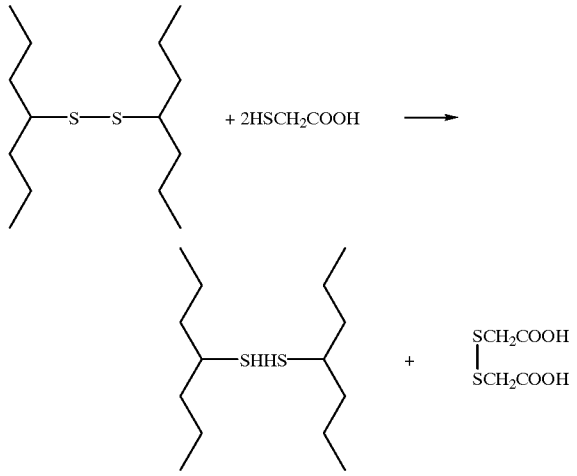

Cystine linkage in hair reacts with thioglycolic acid and is cut, and each sulfur atom couples with a hydrogen atom, and S-H linkage is formed. On the other hand, two molecules of thioglycolic acid couple with each other after the reaction to turn into dithioglycolic acid (DTDG). Incidentally, likewise in the case of cysteine wave agent, cysteine changes into cystine, and acetylcysteine changes into acetylcystine. They flow outside the hair by being washed out in water at the end of the permanent treatment.

When the reaction by the first liquid was finished, a mesh structure of the hair collapses, and keratin gelates. The hair loses elasticity in this way to be softened. The cystine linkage cut in this way is subsequently coupled again by being subjected to an operation by an oxidizer contained by a second liquid, and cystine linkage is re-constructed in keratin as shown in following scheme.

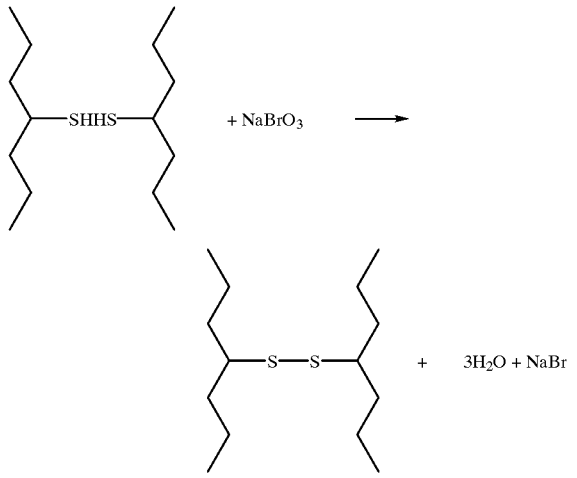

Incidentally, as the chief ingredient of the second liquid, three kinds of sodium bromate ($NaBrO_3$), potassium bromate ($KBrO_3$) and hydrogen peroxide ($H_2O_2$) are employed generally, and, for example, in a case that $NaBrO_3$ is used, $NaBrO_3$ is decomposed into water and sodium bromide (NaBr) after the reaction as shown in the above-mentioned scheme. If attention is paid to cystine linkage, such an operation to hair by permanent liquid can be summarized into the words: "cystine linkage of keratin is cut by means of a reducing agent in the first liquid, and it is re-constructed by an oxidizer in the second liquid to be returned to cystine linkage."

However, treatment of wave hair or straight hair cannot be done only by means of the aforementioned agents of the first liquid and the second liquid. That is, as mentioned above, actions of an agent to hair is cutting and reconstruction of side chain linkage in protein of hair. It is necessary that cystine linkage is reconstructed in a new position of a state in which hair is bent by hair rods or a state in which hair is straightened by a comb during the reaction by such an agent. Therefore, when a wave is given to hair, there is the case that it is preferable to use hair rods to give such a form or the case that operation with the hair iron or the like is necessary; and when hair is straightened, operation of combing or the like becomes necessary.

In addition, in a stage of treating such a hair shape, it is generally performed at the same time to subject the hair to a heat-treatment (physical treatment) to give constant time and constant temperature to the hair. This takes advantage of thermoplasticity of a medulla, cortex, a matrix, the cuticle, and the like, which compose hair for shape transformation effectively and aims at synergy with operation of the aforementioned agent (chemical treatment) to a hair.

However, because a method for treating a hair shape of the previously described permanent treatment or the like uses an agent and heat, for example, in treating a hair shape which takes advantage of an agent, an amount of the agent for usage and use of an agent must be kept strictly, and the agent must be treated carefully. In addition, there is the problem that damage to hair increases when cutting is advanced by the first liquid to such a degree that revitalization of cystine linkage in keratin is impossible, and on the other hand, hair is damaged, and a treatment to give a predetermined hair shape cannot be performed when a treatment by the second liquid is not complete.

Further, there is a fear that health of skin and hair is lost depending on the way of handling an agent for a person constitutionally showing abnormal reaction such as allergic reaction against these agents. Therefore, if operation of an agent to a hair can be made more effective, miscellaneous expenses attendant upon treating a hair shape can be reduced, and damage to hair can be reduced because quantity of an agent to be used can be reduced.

In addition, in treating the hair shape that uses heat, a user must be patient enough to continue sitting down for a long time under a hot electric heater. In addition, there are various kinds of problems that hair is damaged remarkably or a burn is given to head skin or the like when adjustment of temperature is mistaken.

In order to solve the aforementioned problems, JP-A-8-299046 discloses a method to treat a shape of hair by giving supersonic-wave vibration to hair without employing an agent or heat and a device for the method. In addition, JP-A-9-262120 discloses a method to use cold liquid together with supersonic-wave vibration. Further, the hair-set devices which take advantage of supersonic-wave vibration in the same manner are disclosed in JP-A-9-262119, and JP-A-9-262121.

However, how much period a shape of treated hair is held is not disclosed in a J-P-A-8-299046. In addition, in treating hair using supersonic-wave vibration including JP-A-9-262120 referred to above, it is thought that it is preferable that relatively strong vibration is used to such a degree that sufficiently high contact pressure can be given to hair as described in, for example, JP-A-9-262123 disclosing a method for treating hair which takes advantage of supersonic-wave vibration in the same manner. However, it is difficult that such a strong vibration is generated in nature of a vibration-outbreak device in the case of supersonic-wave vibration, and it becomes necessary to use a lower frequency band.

Incidentally, a supersonic wave is used for supersonic-wave diagnosis devices discovering abnormality of the human interior of the body, but there are many unveiled portions as to the influence that a supersonic wave gives to the human body. Supersonic-wave diagnosis devices are limited to temporary use in a diagnosis, but in the case of using a supersonic wave for an appliance to be frequently used in daily life like a hair-treating device (a hair-set device), as a result, the influence of the supersonic wave is continued to give to a brain as a whole for a long time. Thus, there would remain a doubt from the point of security.

The present invention has been made in view of the aforementioned prior-art problems and aims to provide a method for treating hair shape capable of giving a shape to hair smoothly and to keep hair shape for a long term and a treatment apparatus therefor.

SUMMARY OF THE INVENTION

According to the present invention, there is provided a method for treating a hair shape comprising the steps of:

subjecting hair to softening treatment by applying or spraying a softening agent or applying a hair-treating agent, and giving vibration of predetermined frequency not exceeding 20 KHz being lower than that of ultrasonic wave to hair to give a desired shape to hair.

Here, a hair-treating agent means a dyeing agent, a treatment agent, a setting lotion agent, or the like; and more specifically, a hair manicure agent, a hair treatment agent, a hair styling agent, a hair rinse agent, a hair cream agent, a hair mousse agent, a hair gel agent, a hair pack agent, or the like.

In a method for treating a hair shape of the present invention, it is preferable to apply a frequency within a range of 1 Hz to 5000 Hz, more preferably 10 Hz–100 Hz. In addition, a method in which heat of a fixed temperature is given to hair while the vibration is given to hair and/or in at least before or after the vibration is given to hair to give a desired shape to hair is preferably employed.

A hair iron or a hair rod is preferably used as such a means to give a desired shape to hair. Incidentally, in a hair iron, there are various kinds of forms such as a flat iron and a round iron depending on a rod shape. However, the present invention is not limited by its form.

In addition, according to the present invention, there is provided an apparatus to be preferably used in carrying out the aforementioned method for treating a hair shape. That is, according to the present invention, there is provided an apparatus for treating a hair shape to give a desired shape to hair after being subjected to a softening treatment by applying or spraying a softening agent, or after being subjected to applying a hair-treating agent, wherein the apparatus is provided with a vibrating means capable of vibrating with a frequency of not exceeding 20 KHz being lower than the frequency of ultrasonic wave while touching hair to give a desired shape to hair.

Here, it is preferable that the device comprises a heating means to give predetermined heat compulsorily to hair. In addition, as a vibrating means, an electrically operated motor, an electromagnetic actuator, or a ceramic actuator may be used. Further, it is preferable that frequency of the vibrating means can be changed so that a portion touching hair can resonate and a resonance frequency can be changed. In addition, it is also preferable that a grip portion is provided with a vibration proof element so as to reduce vibration transmiting to a human hand by a vibrating means.

One of such treating apparatus for giving desired shape to hair is a hair iron treating hair by sandwiching hair. In this case, it is preferable that the hair iron has such a structure that vibration generated by a vibrating means is given to both or one of the upper rod and the lower rod of the hair iron, or both the upper and the lower rods alternately. Incidentally, as another embodiment of a treating apparatus which gives a desired shape to hair, there is a hair rod around which hair is wrapped to be treated.

Figure 1:
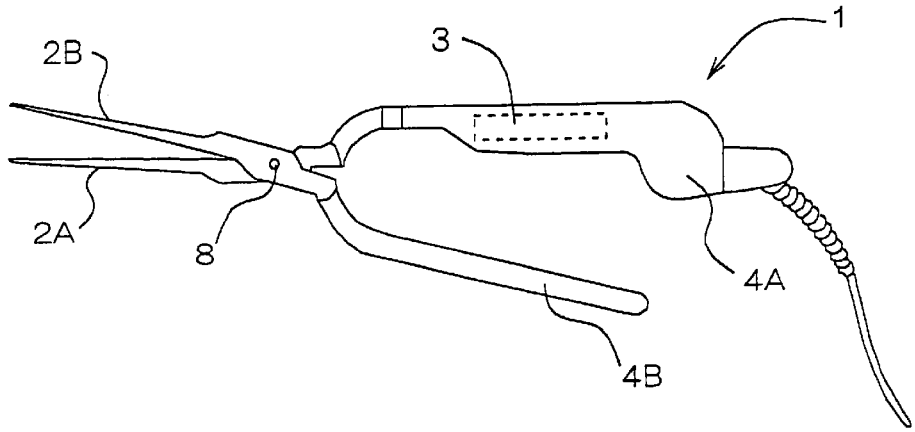
FIG. 1 is a plane view showing an embodiment of a treating apparatus used for a method for treating a hair shape of the present invention.

Modes for carrying out the present invention are hereinbelow described in detail with Example. However, it goes without saying that the present invention is by no means limited to the following modes.

A method for treating a hair shape of the present invention is particularly used for treating a shape of hair, and a softening treatment is given to hair by applying or spraying a softening agent on hair. Further in detail, this softening treatment is performed with washing hair at first, and then, a first liquid (softening agent) is applied or sprayed carefully. Detailed information about an agent used as a first liquid is just as described already.

Incidentally, it is preferable to check a client's hair to know a nature of hair prior to this softening treatment. In this hair check, whether the permanent wave is hard to put on hair, how much hair is damaged, and whether there is a difference in nature between a root and a hairtip. By thus choosing a first liquid suited for nature of the hair based on a result of the check, damage to hair can be reduced, and an effect of the first liquid can be exhibited effectively. For example, it is preferable to choose liquid of high pH on hard hair or virgin hair and liquid of a little low pH on soft hair and dyed hair.

By the way, as one method when permanent wave is put, hair is washed, further a fixed quantity of the hair is gripped to obtain a bunch of hair while combing hair which is softened by means of the first liquid, and hair is treated in a desired shape by putting a wave (a curl) in a uniform direction with a hair iron or by wrapping hair around a hair rod so that generally uniform tension is applied to hair from a hairline to a hairtip.

On the other hand, as one method when a permanent straight is put, after shampoo, a fixed quantity of the combed hair is gripped to obtain a bunch of hair, the bunch of hair is adjusted from a hairline to a hairtip, then a first liquid is applied or sprayed to soften hair, the bunch of hair is adjusted from a hairline to point of a brush while being subjected to combing, and hair is treated with a hair iron to be straight.

In other words, a hair iron or a hair rod is used as a means to give a desired shape to hair, but in the present invention, vibration of predetermined frequency not exceeding 20 KHz which is lower than the frequency of ultrasonic wave is applied to hair when these shape-giving means are used to give a desired shape to hair subjected to softening treatment. It is preferable that this frequency is within the range of 1 Hz to 5000 Hz, more preferable, within the range of 10 Hz–100 Hz.

Incidentally, in a hair iron, there are various kinds of forms such as a flat iron or a round iron depending on a shape of top and bottom rods, but the present invention is not limited by its form. In addition, in the choice of a hair iron or the choice of a hair rod, it is preferable that one having a form (width, thickness, shape) to be fit for the hair is chosen according to a result of the previously described hair check.

Thus, it gets possible to perform a shape-giving treatment of a wave or straight hair very smoothly in comparison with a conventional method. Therefore, it is thought that cutting of side chains such as cystine linkage, salt linkage, hydrogen linkage, etc., composing keratin in softening-treated hair is promoted by applying vibration of the aforementioned frequency.

That is, a permanent treatment has conventionally been performed while an effect of the first liquid was not completely exhibited in order to avoid a damage to hair by the first liquid, but according to the present invention, even in a shape-giving treatment for the same time or the time shorter than a conventional one, the first liquid can act on hair into every portion thereof. As a result, shape can be given more delicately in comparison with conventional one, and the shape is held for a long term.

In the case of using of a method for treating a hair shape of the present invention, as for the maintenance period by one time of treatment, it is confirmed that the shape was kept for about 3 months in a normal life approximately as it was, and an effect of shape maintenance was lasted until about 5 months in a case that some deformation was permitted. On the other hand, when a similar treatment was performed without giving vibration, it was confirmed that the shape was held about 2 months approximately as it was, and the effect of shape maintenance was lasted only for about 3 months in a case that some deformation was permitted.

The reason for this is not certain, but as one reason, it is thought that permeation of the first liquid to hair is helped by physically giving vibration, and an effect of the first liquid is raised. In addition, it is thought as a cause that power applied to transform hair can be taken greatly by making the amplitude great by using a low frequency as compared to a case of using supersonic-wave vibration in prior art.

Further, it is hard to be thought that a frequency of vibration added to hair irons extends to a high frequency band such as a supersonic wave band because hair is stroked, pulled, or pat lightly with a portion of a rod of a hair iron, or the like, in the course of unconsciousness when a barber performs a permanent treatment, and therefore, though it is not out of a guess to the last, it is conceivable that a treatment with a frequency band in the present invention acts as if it substitutes an act of a barber and is caused by the result.

Incidentally, if it is taken into consideration that penetration of the first liquid to hair is helped and an effect of the first liquid is enhanced by the physical treatment of giving predetermined vibration as stated above, it is expected that the present invention takes a superior effect in treatment of hair such as application of a hair manicure, a treatment agent, or the like, too.

Therefore, a hair manicure was applied to a person's hair (head hair) and the hair was treated for the same time with giving vibration to a bunch of some hairs and without giving vibration to another bunch of some hairs with hair irons having the same shape, and it was confirmed that shine of a hair improved in the case that vibration was given.

That is, in the case that the hair to which a treatment agent or the like was applied was treated while vibration of predetermined frequency is added to hair, or in the case that a treatment is performed with vibration of predetermined frequency while a treatment agent or the like is applied to the hair, treatment agent penetrates every portion of hair, the effect is sufficiently exhibited, and a time of treating can be shortened. To hold properties of treated hair effectively for a long time can be expected by this.

By the way, on the occasion of the aforementioned treating of a hair shape with a hair iron or a hair rod, it is preferable that heat of uniform temperature is given to hair while the vibration is given to hair and/or in at least one of the times before and after the vibration is given to hair. Plasticity of hair is increased by giving this heat, and a desired shape can be given to hair in a shorter time in comparison with the case that only vibration was added.

By the way, there are three kinds of methods in giving vibration to hair by oscillating the upper and/or the lower rod(s) of a hair iron: a method to oscillate only one of rods greatly, a method to oscillate both rods simultaneously, a method to oscillate both rods alternately, and in the present invention, any method of these may be used according to a treating shape of a hair.

In addition, when a wave shape was given to a hair by means of a hair rod, a vibration stick was interposed in a hollow portion of the hair rod around which hair was wrapped, and vibration of predetermined frequency was given to the hair rod, or heat of uniform temperature was given simultaneously. while vibration was given. As a result, wave treating could be performed very smoothly. That is, when a hair rod is used, hair rod itself may have a vibrating means or a heating means. In addition, though a vibrating means or a heating means is not provided on a hair rod itself, vibration and heat may be added to a hair rod from the outside by using another apparatus to add vibration or heat.

Thus, in a method for treating a hair shape of the present invention, a treatment is performed while vibration of constant frequency is given to a hair. The amplitude of vibration of this time depends on various kinds of factors such as a form of generation source of vibration, a size of input energy, an energy conversion efficiency of input and output energy, a wearing position in a hair-treating apparatus such as a hair iron, and a shape of a hair-treating apparatus.

However, it is preferable that contact pressure with hair and a vibration body (a location contacting hair in a treating apparatus) is big so that it is disclosed in a JP-A-9-262123 in order to perform a good-shape treatment. It was thought that even if a frequency band to be used was different, it was similar in the present invention from a viewpoint of transmission of power to hair.

Therefore, in the present invention, it is preferable to design a form of a treating apparatus (structure, shape, material) so as to give a big amplitude in order to give strong contact pressure to at least several ten hairs simultaneously. Actually, it was ensured that a shape is given to hair well by increasing the amplitude of vibration by inputting high energy in the case that input energy to a vibrating means is varied with frequency being kept uniform.

The second liquid (a hardening agent) is sufficiently applied to hair after treatment of a hair shape is performed in the state that the first liquid is applied as stated above. When application of the second liquid is undertaken, the first liquid may be washed away by warm water or the like beforehand, or the second liquid can be applied directly without washing away the first liquid. In any of the cases, a softening effect of the first liquid is stopped by application of the second liquid. Incidentally, because second liquid has the lower permeability than the first liquid, it is preferable that application treatment is divided into several times with intervals of predetermined time.

Cystine linkage minutely cut in every portion in comparison with a conventional permanent treatment by a shape-giving treatment by the first liquid and a hair iron is re-constructed by means of operation of the second liquid. A shape is hard to be deformed by repeating the later shampoo or the like, and shape maintenance of a long term can be attained since a shape thus given to the details of hair is held.

If a hardening treatment by the second liquid is finished, a hair rod is detached when hair is wrapped around a hair rod. In the case that the first liquid has not been washed away, the first liquid is washed away with the second liquid, and in the case that the first liquid has already been washed away, the second liquid is sufficiently washed away by warm water or the like from the treated hair. Then, hair is dried to complete a permanent treatment.

The above is only a mode of a method for treating a hair shape of the present invention. For example, when putting permanent wave on hair, it is possible that washed hair is wrapped around a hair rod, in the sequel, the first liquid is applied or sprayed carefully and left until the first liquid permeates into hair, then, vibration is added to the hair rod to promote to give a shape. In addition, it is also preferable that washed hair is wrapped around a hair rod, in the sequel, the first liquid is applied or sprayed with vibration being applied to the hair rod to permeate the first liquid in hair to give a desired shape to hair. Further, it is preferable that softening of hair is promoted by giving heat to hair simultaneously at least either before or after of this treatment or during this treatment.

It can be performed in the same manner in case of permanent straight by the use of a hair iron and light wave permanent. That is, there may be employed a method to give desired shape to hair by applying the first liquid by spraying or the like while a shape is given by a hair iron with adding vibration to the washed hair. It is preferable that heat is given to hair at this time or after a treatment by a hair iron has finished. Thus, in the present invention, application of the first liquid is not always prior to a shape-giving treatment by the use of vibration.

Incidentally, in late years, permanent to be treated only with one kind of treatment liquid gets possible without using two kinds of liquids of the first liquid and the second liquid. In the case of a permanent treatment to hair by treating with one kind of liquid, this liquid is deemed to be the previously described first liquid, and a method for treating a hair shape of the present invention can be applied.

Next, a mode of a treatment apparatus suitably used for the aforementioned method for treating a hair shape of the present invention is described with reference to drawings. But, a treatment apparatus of the present invention is not limited to the following embodiments.

FIG. 1 is a plane view showing an embodiment of a hair iron 1 which is suitably used for a method for treating a hair shape of the present invention. It goes without saying that hair is put between the upper and the lower rods 2A and 2B of the hair iron 1, and the hair iron 1 is moved to give a desired shape to the hair. A vibrating means 3 is provided in a grip portion 4A, which is an extended portion of the lower rod 2A of the hair iron 1. As this vibrating means 3, there may be used an electrically operated motor such as a small motor or a flat motor or an electromagnetic actuator or a ceramic actuator, or the like. In the present invention, an apparatus capable of generating arbitrarily vibration of a frequency of less than or equal to 5000 Hz is used.

Incidentally, it is preferable to provide a control switch so as to be able to control size of vibration amplitude or to provide a switch for changing frequency so that the amplitude can be increased by resonating the hair ion 1 itself or resonating the upper and lower rods 2A and 2B in direct contact with hair or so that the resonance frequency can be varied. A resonance frequency of the upper and lower rods 2A and 2B can be changed by variously changing shape by changing thickness and width of the upper and lower rods 2A and 2B, by forming a surface into a curved surface and changing the curvature, or the like.

A vibrating means 3 may be provided in a grip portion 4B, which is an extended portion of the upper rod 2B, or it may be provided in both the top and bottom rods 2A and 2B. Even if a vibrating means 3 is provided in only a grip portion, for example 4A, like the hair iron 1, vibration is generally reached to the upper rod 2B by means of a contact portion between the upper and lower rods 2A and 2B of a rivet portion 8 or the like, and both the upper and lower rods 2A and 2B vibrate. However, it is also possible that vibration of the upper rod 2B is restrained by providing a vibration-proof means in such a manner that a vibration-control material intervenes in the rivet portion 8 to make only the lower rod 2B vibrate.

In this way, in giving vibration to a hair by a vibrating means 3, a method by vibrating both the upper and lower rods 2A and 2B simultaneously, a method by vibrating only one of them, a method by vibrating both upper and lower rods 2A and 2B alternately, or the like, can be selected appropriately.

It is not depicted in the hair iron 1, but it is preferable that the hair iron 1 is provided with a heating means to give heat to hair forcibly by providing a heater within the upper and lower rods 2A and 2B, or the like. Thus, it is preferable to be able to control temperature within 60° C.–200° C. in the case of heating the upper and lower rods 2A and 2B directly. In addition, it is also possible to provide a heating means in a grip portions 4A and 4B with a warm wind or a hot wind as long as operability of the hair iron 1 is not impaired.

Figure 2:
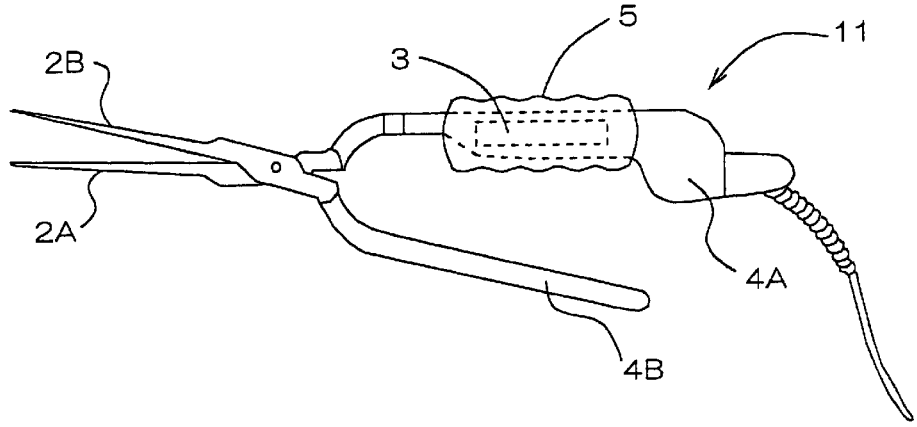
FIG. 2 is a plane view showing another embodiment of a treating apparatus used for a method for treating a hair shape of the present invention.

Since a vibrating means 3 is disposed in the grip portion 4A in the hair iron 1, the hair iron 1 itself vibrates, i.e., vibration is transmitted to a hand of a person grasping the grip portions 4A and 4B. In restraint of this transmission of vibration to hand, it is preferable to employ a mode in which a vibration-absorbing body 5 is disposed in the grip portion 4A as a vibration-proof device like a hair iron 11 shown in FIG. 2.

Figure 3:
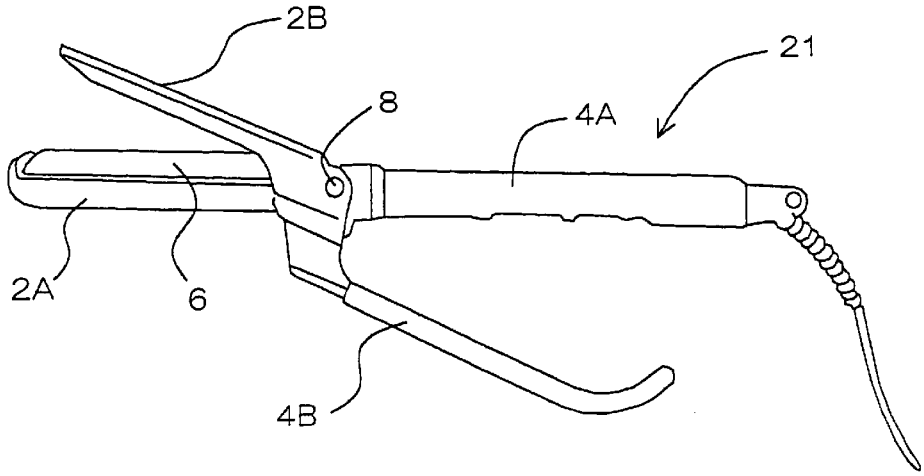
FIG. 3 is a perspective view showing still another embodiment of a treating apparatus used for a method for treating a hair shape of the present invention.

A hair iron 21 shown in FIG. 3 shows the mode in which a ceramic actuator 6 as a vibrating means 3 is disposed in a surface touching hair directly in the lower rod 2A of the top and bottom rods 2A and 2B. Since predetermined vibration can be given directly to hair in the state that hair is sandwiched in hair iron 21, loss in transmitting vibration to hair becomes small, energy efficiency is good because the ceramic actuator 6 convert electric energy directly to energy of mechanical vibration, and electric energy saving can be attained.

Incidentally, in the hair iron 21, transmission of vibration to rod 2B can be controlled by employing a vibration-proof measure between the ceramic actuator 6 and the lower rod 2A. On the other hand, it is also possible that vibration of ceramic actuator 6 is transmitted to the lower rod 2A, and further to the upper rod 2B by means of the rivet part 8.

Figure 4:
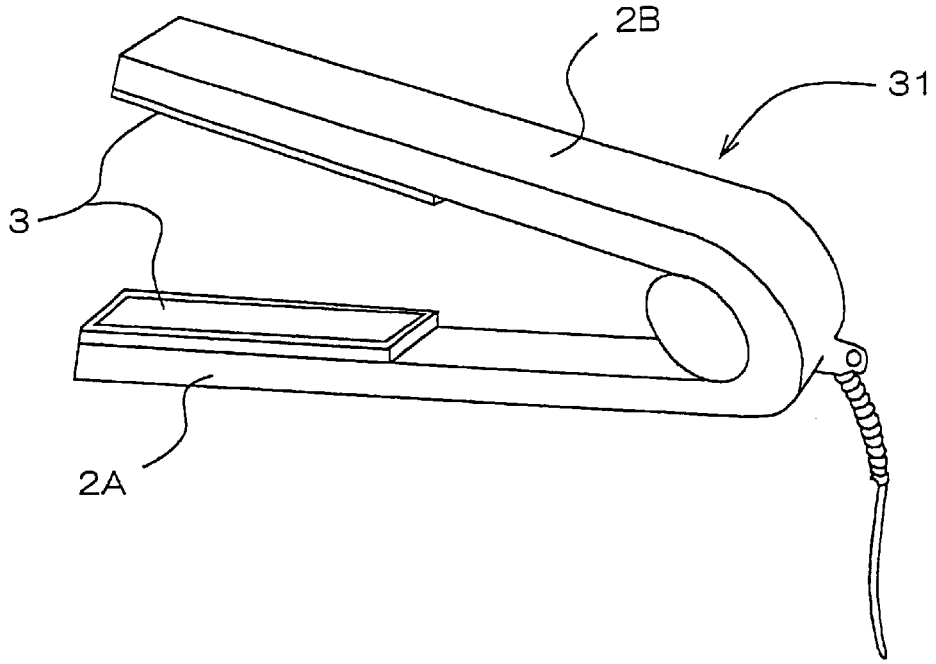
FIG. 4 is a perspective view showing yet another embodiment of a treating apparatus used for a method for treating a hair shape of the present invention.

A hair iron 31 shown in a perspective view of FIG. 4 shows a mode in which vibrating means 3 are disposed on a portion where hair is put in both the top and bottom rods 2A and 2B. A hair iron 31 has a structure in which the top and bottom rods 2A and 2B also serves as a grip portion in comparison with the hair irons 1, 11 and 21. Incidentally, vibrating one of or both the vibrating means 3 can be easily controlled by providing a vibration-proof measure between vibrating means 3 and the upper and lower rods 2A and 2B in hair iron 31.

Figure 5:
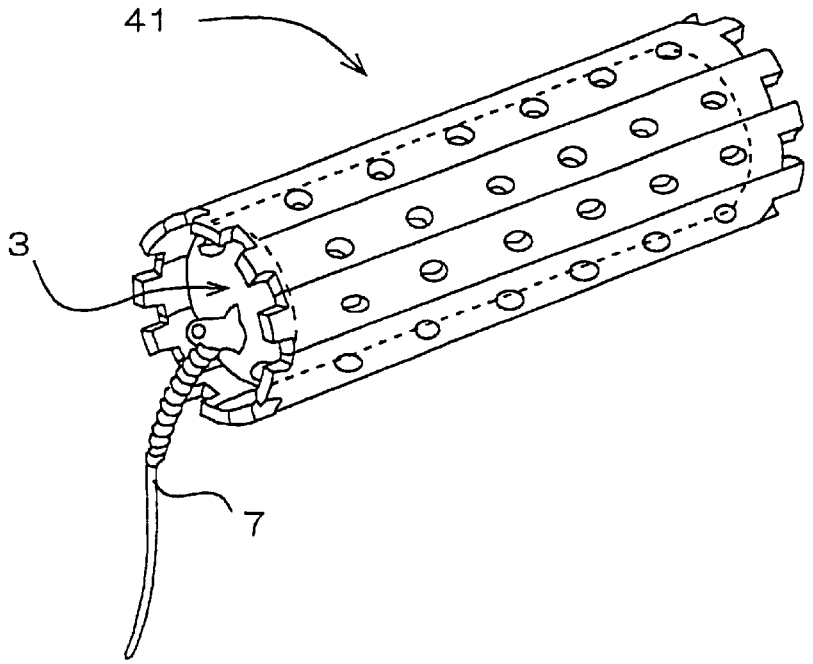
FIG. 5 is a perspective view showing yet another embodiment of a treating apparatus used for a method for treating a hair shape of the present invention.

Next, FIG. 5 shows a perspective view of a hair rod 41, which is one embodiment of apparatuses for treating a hair shape of the present invention. In a hollow portion of the hair rod 41, a vibrating means 3 is built in to have a compact structure. Here, as a vibrating means 3 inserted into a hollow portion, it is preferable that a light one is adopted so as not to give more weight than it needs to hair. Therefore, it is preferable that a thin cylindrical vibrating body is disposed along the internal circumferential surface of the hair rod 41.

Incidentally, there is the case that workability deteriorates by an electric-source cord 7 which becomes an obstacle when hair is wrapped around the hair rod 41. Therefore, it is preferable that a cylindrical hair rod and a cylindrical or column-shaped vibrating means are constituted by different detachable parts.

As described above, according to the method for treating a hair shape of the present invention, it is possible to cause cutting of cystine linkage, salt linkage, hydrogen linkage or the like in keratin of the hair, which was hard to be done in a conventional permanent treatment, to every portion of hairs by making an effect of the first liquid (softening agent) being sufficiently exhibited in permanent treatment of permanent straight or permanent wave. In this way, the present invention takes effect of getting possible to perform a treatment of giving a hair shape smoothly and superior effect of getting possible to shorten time of the treatment. In addition, after a hardening treatment, an effect of giving a shape is given to every portion of hair because cystine linkage of keratin reaching the details of hair is re-constructed. Therefore, it takes superior effect in maintaining a hair shape after the shape has been treated for a long term. Further, there is an advantage of getting possible to give a graceful or remarkable shape to hair because it becomes possible to perform a treatment of a delicate shape, which could not be performed by a conventional wave permanent, or the like.

What is claimed is:

1. A method of conforming hair to a desired hair shape, comprising a plurality of steps of:

performing a softening treatment to the hair by applying one of a softening agent and a hair-treating agent, and vibrating the hair to the desired hair shape by applying a predetermined frequency not exceeding 20 KHz while a heat treatment is given to the hair.

2. The method of claim 1, wherein said predetermined frequency is within a range from 1 Hz to 5000 Hz.

3. The method of claim 1, wherein said predetermined frequency is within a range from 10 Hz to 100 Hz.

4. The method of claim 1, wherein heat of uniform temperature is applied to the hair while one of, before and after vibrating the hair to the desired shape.

5. The method of claim 1, wherein the desired hair shape is conformed by one of a hair iron and a hair rod.

6. An apparatus for conforming hair to a desired hair shape after performing a hair softening treatment to the hair by applying one of softening agent and hair-treating agent, comprising:

vibrating means for vibrating the hair at a predetermined frequency not exceeding 20 KHz; and heating means for heating the hair;

wherein heat and vibration are concurrently applied to the hair to conform the hair to the desired hair shape.

7. The apparatus of claim 6, wherein said vibrating means is one of an electromotive motor, an electromagnetic actuator, and a ceramic actuator.

8. The apparatus of claim 6, wherein the predetermined frequency of the vibrating means is adjustable.

9. The apparatus of claim 6 further comprises a grip portion;

wherein the grip portion is provided with a vibration-proof element.

10. The apparatus of claim 6, wherein said apparatus is a hair iron with an upper portion and a lower portion holding the hair therebetween.

11. The apparatus of claim 10, wherein vibration generated by said vibrating means is transmitted to one of the upper rod and the lower rod or both the upper and lower rods alternately.

12. The apparatus of claim 6, wherein said apparatus is a hair rod around which hair is wrapped thereon.

* * * * *